US006593278B2

(12) United States Patent
Yeganeh et al.

(10) Patent No.: US 6,593,278 B2
(45) Date of Patent: Jul. 15, 2003

(54) METHOD FOR INHIBITING CORROSION USING CERTAIN PHOSPHORUS AND SULFUR-FREE COMPOUNDS

(75) Inventors: Mohsen S. Yeganeh, Piscataway, NJ (US); Shawn Michael Dougal, Livingston, NJ (US); Guido Sartori, Milan (IT); David Craig Dalrymple, Bloomsbury, NJ (US); Cheayao Zhang, Annandale, NJ (US); Saul Charles Blum, Edison, NJ (US); Liza Marie Monette, Whitehouse, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 186 days.

(21) Appl. No.: 09/905,153

(22) Filed: Jul. 13, 2001

(65) Prior Publication Data

US 2003/0012681 A1 Jan. 16, 2003

(51) Int. Cl.[7] ..... C23F 11/12; C23F 11/14; C23F 11/04; C09K 15/08; C09K 15/18; C09K 15/24

(52) U.S. Cl. ..... 507/245; 507/241; 507/260; 507/263; 507/264; 507/934; 507/939; 252/390; 252/392; 252/393; 252/394; 252/403; 252/404; 252/405; 166/902; 427/435; 422/7

(58) Field of Search ..... 252/387, 390, 252/392, 393, 394, 399, 401, 403, 404, 405; 507/245, 241, 260, 263, 264, 934, 939; 106/14.13, 14.15, 14.26, 14.27, 14.31; 166/902; 427/435; 422/7, 12, 17; 148/320

(56) References Cited

U.S. PATENT DOCUMENTS

| | | | | |
|---|---|---|---|---|
| 3,578,731 A | | 5/1971 | Mange et al. | 260/929 |
| 4,024,050 A | | 5/1977 | Shell et al. | 208/48 AA |
| 4,061,714 A | * | 12/1977 | Turner | 423/220 |
| 4,204,970 A | * | 5/1980 | Lee et al. | 252/403 |
| 4,347,148 A | * | 8/1982 | Davis | 44/70 |
| 4,502,979 A | * | 3/1985 | McCullough et al. | 252/394 |
| 4,758,312 A | * | 7/1988 | Hunt et al. | 436/6 |
| 4,941,994 A | | 7/1990 | Zetlmeisl et al. | 252/389.23 |
| 5,314,643 A | | 5/1994 | Edmondson et al. | 252/389.23 |
| 5,425,267 A | | 6/1995 | Herrmann et al. | 73/86 |
| 5,498,813 A | | 3/1996 | Arnst | 585/466 |
| 5,500,107 A | | 3/1996 | Edmondson | 208/47 |
| 5,503,006 A | | 4/1996 | Babaian-Kibala et al. | 73/86 |
| 5,552,085 A | | 9/1996 | Babaian-Kibala | 252/389.23 |
| 5,611,991 A | | 3/1997 | Naraghi | 422/15 |
| 5,630,964 A | | 5/1997 | Babaian-Kibala et al. | 252/389.23 |
| 5,863,415 A | | 1/1999 | Zetlmeisl | 208/47 |

* cited by examiner

*Primary Examiner*—Joseph D. Anthony
(74) *Attorney, Agent, or Firm*—Linda M. Scuorzo

(57) ABSTRACT

The present invention relates to a method for inhibiting corrosion of corrosion-prone metal surfaces by organic acid-containing petroleum streams by providing an effective corrosion-inhibiting amount of certain sulfur and phosphorus-free aromatic compounds substituted with nitrogen, containing functional groups at the 5- or 3, 5-position, typically up to 1000 wppm, to the metal surface.

4 Claims, No Drawings

METHOD FOR INHIBITING CORROSION USING CERTAIN PHOSPHORUS AND SULFUR-FREE COMPOUNDS

FIELD OF THE INVENTION

The field of the invention relates to a process for inhibiting the high temperature corrosivity of petroleum oils.

BACKGROUND OF THE INVENTION

Whole crudes and crude fractions with acid, including high organic acid content such as those containing carboxylic acids, (e.g., naphthenic acids), are corrosive to the equipment used to distill, extract, transport and process the crudes. Solutions to this problem have included use of corrosion-resistant alloys for equipment, addition of corrosion inhibitors, or neutralization of the organic acids with various bases.

The installation of corrosion-resistant alloys is capital intensive, as alloys such as 304 and 316 stainless steels are several times the cost of carbon steel. The corrosion inhibitors solution is less capital intensive, however, costs can become an issue.

Thus, there is a continuing need to develop additional options for mitigating the corrosivity of acidic crudes. It is particularly desirable to provide for mitigation options that use phosphorus and sulfur-free compounds, since these can present downstream catalyst and/or product quality issues. Applicants' invention addresses these needs.

SUMMARY OF THE INVENTION

An embodiment of the invention is a method for inhibiting the high temperature corrosion of corrosion-prone metal surfaces caused by organic, typically naphthenic acids in petroleum streams by providing the metal surface with an effective corrosion-inhibiting amount of certain sulfur and phosphorus-free aromatic compounds substituted with nitrogen containing functional groups at the 5-, or 3, 5-position compounds.

The effectiveness of corrosion inhibition is typically estimated in the laboratory by weight loss of metal coupons exposed to organic acids with and without additive present. The relative decrease in metal weight loss due to the presence of the corrosion inhibitor is a measure of the effectiveness of corrosion inhibition.

The present invention may suitably comprise, consist or consist essentially of the elements disclosed and may be practiced in the absence of an element not disclosed.

DETAILED DESCRIPTION OF THE PREFERRED EMBODIMENTS

Some petroleum streams contain acids, including organic acids such as naphthenic acids that contribute to high temperature corrosion of internal surfaces refinery equipment. Organic acids generally fall within the category of naphthenic and other organic acids. Naphthenic acid is a generic term used to identify a mixture of organic carboxylic acids present in petroleum stocks. Naphthenic acids may be present either alone or in combination with other organic acids, such as phenols. Naphthenic acids alone or in combination with other organic acids can cause corrosion at high temperatures in non-aqueous or essentially non-aqueous (hydrocarbon) environments, i.e., at temperatures ranging from about 200° C. (392° F.) to 420° C. (790° F.). Inorganic acids also may be present. Inhibition of corrosion due to the organic acid content of such petroleum streams, is desirable in order to increase the corrosion resistance, and, thus, useful life of internal (i.e., tube-side surfaces of reactors and other equipment having an external or shell side and an internal or tube side) metal surfaces that are high temperature corrosion-prone and are to be exposed to organic acid-containing petroleum streams at process conditions that result in corrosion of such internal surfaces. It is particularly desirable to provide for mitigation options that use sulfur and phosphorus-free compounds as additives or inhibitors since the presence of phosphorus and sulfur can affect downstream catalysts and/or product quality. Examples of such equipment include heat exchanger surfaces, pipestill vessels, transfer lines and piping and pumps. Examples of metal surfaces that may benefit from treatment are ferrous metals such as carbon steel on iron alloys.

Petroleum streams that can be treated herein are any organic acid-containing petroleum streams, including whole crudes and crude oil fractions. As used herein, the term whole crudes means unrefined, non-distilled crudes.

Treatment temperatures will preferably range from about ambient to, typically about 450° C., preferably up to 350° C.

The compounds are added in effective amounts, typically up to a total of 1000 wppm, more typically an effective amount of from about 10–1000 wppm.

The inhibitor is introduced in either a batch or continuous process to untreated (unadditized) petroleum oil. Additionally or separately, the metal surface may be preconditioned by adding to a low acidity petroleum feed an amount of inhibitor (additive effective to inhibit corrosion in the organic acid-containing petroleum oil to be treated) before combination with the petroleum stream containing organic acids and blending them by techniques known in the industry. Additional effective amounts may be introduced into the organic acid-containing petroleum stream itself as needed to maintain corrosion inhibition. Desirably, a continuous dosing of the inhibitor to achieve and maintain the effective level of corrosion inhibition is delivered. Typically, a reduction corresponding to at least a fifty (50) percent corrosion rate reduction can be achieved. Thus, the additive/inhibitor may be introduced to the hydrocarbon-rich environment or phase and/or to the metal surface itself.

The inhibitor is added in effective amounts, typically up to a total of 1000 wppm, more typically an effective amount of from about 10–100 wppm.

Another embodiment of the invention is a method to inhibit the high temperature corrosivity of an organic acid-containing petroleum stream or oil by providing a corrosion-prone metal-containing surface to be exposed to the acid containing petroleum stream with an effective, corrosion-inhibiting amount of the inhibitor at a temperature and under conditions sufficient to inhibit corrosion of the metal surface. The providing of the inhibitor may be carried out in the presence of the acid-containing petroleum stream and/or as a pretreatment of the corrosion-prone metal surface before exposure to the acid-containing petroleum stream. The compounds are preferably 5-aminoisophthalic acid, 3, 5-dinitrophenol and 3, 5-dinitroaniline. Another embodiment provides for the compositions produced by the process.

The effectiveness of corrosion inhibition is typically estimated in the laboratory by weight loss of metal coupons exposed to organic acids with and without the inhibitor present. The relative decrease in metal weight loss due to the presence of corrosion inhibitor is a measure of the effectiveness of corrosion inhibition.

Naphthenic acid concentration in crude oil is determined by titration of the oil with KOH, until all acids have been neutralized. The concentration is reported in Total Acid Number (TAN) unit, i.e., mg of KOH needed to neutralize 1 gram of oil. It may be determined by titration according to ASTM D-664. Any acidic petroleum oil may be treated according to the present invention, for example, oils having an acid neutralization of about 0.5 mg KOH/g or greater.

EXAMPLE 1

The reaction apparatus consisted of a 500-ml round bottom flask under nitrogen atmosphere. 288.9 grams of Tufflo oil was put in the flask, then 12 mg 5-aminoisophthalic were added. The flask contents were brought to 300° C. and a carbon steel coupon with dimensions 7/16 in.×11/16 in.×1/8 in. was immersed. Initial coupon weight was determined to be 4.7535 g. After an hour, 11.1 grams of naphthenic acids were added, giving a total acid number of 8 mg KOH/g. The oil was kept at 300° C. for an additional 4 hours. The coupon weighted 4.7457 g after this procedure, corresponding to a corrosion rate of 143 mils per year.

EXAMPLE 2 (Comparative)

The procedure was the same as in example 1, without 5-aminoisophthalic. The coupon was kept in oil at 300° C. for four hours. The weight loss corresponded to a corrosion rate of 480 mils per year. Thus, in Example 1, a 70% corrosion rate reduction was measured when 5-aminoisophthalic was present versus Example 2 when this compound was absent.

EXAMPLE 3

Example 1 was repeated, using a smaller amount of naphthenic acids. 295.8 g of Tufflo oil were put into the flask and 12 mg of 5-aminoisophthalic were added. A coupon was suspended in the flask for pre-treatment for 1 hour. 4.2 g of naphthenic acids were added to give a total acid number of 3 mg KOH/g. The oil was kept at 300° C. for an additional 4 hours. The coupon weight loss corresponded to a corrosion rate of 5 mils per year.

EXAMPLE 4 (Comparative)

Example 3 was repeated, with same amounts of Tufflo oil and naphthenic acids as in Example 3. The measured weight loss corresponded to a corrosion rate of 141 mils per year. Thus, in Example 3, a 96% corrosion rate reduction was measured when 5-aminoisophthalic was present versus Example 4 when this compound was absent.

EXAMPLE 5

The procedure was the same as in Example 1, but without 5-aminoisophthalic and with 12 mg of 3, 5-dinitrophenol. The weight loss corresponded to a corrosion rate of 166 mils per year. Thus, in Example 3, a 65% corrosion rate reduction was measured when 3, 5-dinitrophenol was present versus Example 2 when this compound was absent.

EXAMPLE 6

The procedure was the same as in Example 1, but without 5-aminoisophthalic and with 12 mg of 3, 5-dinitroaniline. The weight loss corresponded to a corrosion rate of 155 mils per year. Thus, in Example 3, a 68% corrosion rate reduction was measured when 3, 5-dinitroaniline was present versus Example 2 when this compound was absent.

What is claimed is:

1. A process for inhibiting the high temperature corrosivity occurring at from 200° C. to 420° C. of an organic acid-containing petroleum stream when in contact with a corrosion prone metal surface; said process is incorporating a corrosion inhibiting effective amount of sulfur and phosphorus-free aromatic compounds substituted with nitrogen containing functional groups at the 5- or 3, 5-position into said organic acid-containing petroleum stream which is in contact with said corrosion prone metal surface.

2. The process of claim 1, wherein the amount of compound is an effective amount of up to 1000 wppm.

3. The process of claim 1, wherein the compounds are selected from the group consisting of 5-aminoisophthalic acid, 3, 5-dinitrophenol and 3, 5-dinitroaniline.

4. The process of claim 1, wherein the metal is a iron-containing metal.

* * * * *